US007545389B2

(12) United States Patent
Proteau et al.

(10) Patent No.: US 7,545,389 B2
(45) Date of Patent: Jun. 9, 2009

(54) ENCODING CLEARTYPE TEXT FOR USE ON ALPHA BLENDED TEXTURES

(75) Inventors: Stephen P. Proteau, Bothell, WA (US); Robert F. Day, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 10/843,206

(22) Filed: May 11, 2004

(65) Prior Publication Data

US 2005/0253865 A1 Nov. 17, 2005

(51) Int. Cl.
*G09G 5/00* (2006.01)

(52) U.S. Cl. ..... 345/629; 345/611

(58) Field of Classification Search ..... 345/630–641, 345/611, 629

See application file for complete search history.

(56) References Cited

U.S. PATENT DOCUMENTS 4,827,253 A * 5/1989 Maltz ..... 345/640
5,351,067 A * 9/1994 Lumelsky et al. ..... 345/561
5,940,080 A * 8/1999 Ruehle et al. ..... 345/611
6,023,302 A * 2/2000 MacInnis et al. ..... 348/597
6,486,888 B1 * 11/2002 Fushiki et al. ..... 345/592
6,545,724 B1 * 4/2003 Gryskiewicz ..... 348/597
6,738,072 B1 * 5/2004 MacInnis et al. ..... 345/629
6,760,028 B1 * 7/2004 Salesin et al. ..... 345/469
2001/0048764 A1 * 12/2001 Betrisey et al. ..... 382/162
2003/0184553 A1 * 10/2003 Dawson ..... 345/581
2004/0151398 A1 * 8/2004 Betrisey et al. ..... 382/260
2004/0233215 A1 * 11/2004 Dawson ..... 345/592
2005/0110804 A1 * 5/2005 Hancock et al. ..... 345/640

* cited by examiner

*Primary Examiner*—Kee M Tung
*Assistant Examiner*—Daniel Washburn
(74) *Attorney, Agent, or Firm*—Shook, Hardy & Bacon, L.L.P.

(57) ABSTRACT

Provided is a method where a background ARGB must not be taken into consideration before a foreground ARGB including TrueType fonts is combined therewith to create a composite image for display on a display device. A common alpha value is made use of in the process of combining the foreground ARGB with the background ARGB to create the composite image.

12 Claims, 5 Drawing Sheets

ENCODING CLEARTYPE TEXT FOR USE ON ALPHA BLENDED TEXTURES

FIELD OF THE INVENTION

The present invention generally relates to the field of sub-pixel rendering techniques used with matrix digital displays. More specifically, the present invention generally relates to a method for improving an amount of resources required when rendering ClearType® text on a background displayed on a matrix digital display.

BACKGROUND OF THE INVENTION

To date, the state-of-the-art methods for improving the definition of text graphics, including Microsoft ClearType® technology, increase the potential display resolution of text on a color matrix digital display device by using conventional sub-pixel rendering techniques. The improvement of the on-screen reading experience resulting from the sub-pixel rendering methods has enabled the emergence of new product categories, such as electronic books (e-books). The improved rendering techniques have also benefited the display of existing spreadsheets, word processing documents, and Internet content, which display text using fonts which have been rendered for color matrix displays.

There are several types of sub-pixel rendering techniques in use today. One type is known as "anti-aliasing." Anti-aliasing was developed to make blocky letters easier for the human eye to resolve. Another text-rendering technique uses Microsoft's ClearType® technology. The ClearType® technology uses a filtering technique to enhance the resolution and readability of text rendered on displays that contain a repeating pattern of addressable colored sub-pixels. These two techniques are described in further detail below.

A single pixel of a typical digital color matrix display device, such as a liquid crystal device (LCD) display or a plasma display panel (PDP) display is composed of three in-line "sub-pixels": one red, one green, and one blue (RGB). The sub-pixel triad forms a single pixel. The linear array of color sub-pixels translates to a horizontal resolution of three times the maximum horizontal resolution that could be achieved for the display. Therefore, addressing the actual sub-pixels individually and ignoring their different colors can provide as much as three times the horizontal resolution from the existing digital matrix display panels than if single pixel addressing were used. Sub-pixel rendering works because human eyes perceive changes in luminance with greater resolution than changes in color.

When a white line is presented on a color matrix display, what is really being displayed is a line of sub-pixel triads of red, green, and blue. The human eye does not perceive these closely spaced colors individually because the vision system does not see color changes at high resolution. Accordingly, the human eye mixes the three primary colors in combination to form intermediates. However, the eye can register the three primary colors when single sub-pixels of the primary color signals are exclusively illuminated in a multi-pixel area. All other combinations of the primary color signals are perceived as intermediate (secondary and tertiary) color signals. The combination of all three color signals in the proper intensity is perceived as white, and the absence of all color signals is perceived as black.

A conventional method for controlling the sub-pixels is through rendering. Rendering can map pixels of a font/letter onto sub-pixels in a particular sequence in order to achieve optimum resolution for the font. For example, FIG. 1 shows a 12-point regular (non-italics, non-bold) "S" rendered using full-pixel rendering techniques. FIG. 2 illustrates what the capital "S" looks like at the sub-pixel level when the pixels shown in FIG. 1 are shifted one-third of a pixel to the right. The result is a blocky letter which may be difficult for the human eye to resolve.

The technique known as "anti-aliasing" was developed to make blocky letters easier to resolve. Using this technique, FIG. 3 illustrates the capital "S" of FIG. 2, where partially filled pixels are each rendered with a prescribed gray level. In particular, a one-third-filled pixel is assigned a light gray, and a two-thirds-filled pixel is assigned a dark gray. The human eye will tend to average gray pixels with the adjacent pixels. FIG. 4 illustrates the anti-aliased letter rendered for a color matrix display, with red-green-blue sequenced sub-pixels elements (color not shown). In this image, the coloration of the sub-pixels of the letter corresponds to the horizontal position of the visual energy.

The Microsoft ClearType® technology improves on the anti-aliasing technique described above. Actual pixels of an LCD are tall rectangles of red, green and blue, and hardware associated with LCD can generally address the individual components of a pixel separately. Therefore, if software treats RGB as a single unit, an image of all red pixels will be offset one-third pixel to the left of an image of all green pixels, and an image of all blue pixels will be offset one-third pixel to the right. In order to draw a font using the ClearType® technology, the font is first drawn three times as wide as normal, while using anti-aliasing to smooth sloped edges. Then, a low-pass filter is applied to the font to avoid color fringing. The process for controlling color fringing takes into account the background color the font is going to be drawn on. The ClearType® Microsoft technology uses a three-tap finite impulse response (FIR) filter. Using this filter, the RGB components of the font are sampled alternately to produce a final image at nearly triple the apparent horizontal resolution of an ordinarily anti-aliased font. Further information regarding Microsoft's ClearType® can be found in Betrisey, C., Blinn, J. F., Dresevic, B., Hill, B., Hitchcock, G., Keely, B., Mitchell, D. P., Platt, J. C., Whitted, T., "Displaced Filtering for Patterned Displays," *Proc. Society for Information Display Symposium*, pp. 296-299 (2000). The entire contents of the article are hereby incorporated herein by reference.

Both the anti-aliasing and ClearType technologies are generally used in conjunction with TrueType fonts. TrueType fonts were developed by Apple, and the technology includes the use of a rasterizer along with the actual TrueType font itself. The rasterizer is a piece of software that is embedded in an operating system. The rasterizer gathers information on the size, color, orientation, and location of all the TrueType fonts displayed in the operating system, and converts that information into a bitmap that can be understood by a graphics card and a display device. Thus, the rasterizer is essentially an interpreter that understands mathematical data supplied by a given font, and translates the data into a form that is capable of being rendered by a display device.

The actual fonts themselves contain data that describes the outline of each character in the typeface. The fonts may also include data that corresponds to hinting codes. Hinting is a process that makes a font that has been scaled down to a small size look its best. Instead of simply relying on a vector outline, the hinting codes ensure that the characters line up well with the pixels of the display device so that the font looks as smooth and legible as possible. The process of improving the resolution of any given font, including a TrueType font, may also include the use of anti-aliasing or the use of ClearType® technology.

Recently, many applications that are used in conjunction with graphical user interfaces use a technology referred to as alpha blending to create the effect of transparency. This is useful when creating graphical effects that include combining a semi-translucent foreground with a background color to create an in-between blend. For example, in a graphical user interface (GUI), it may be desirable to superimpose a semi-translucent window over a window having a solid background. In this case, the information in both the semi-translucent window and the background window would be apparent to a user of the GUI.

In the foregoing, the use of the colors red, green, and blue have been discussed in conjunction with displaying fonts on the display device. However, in the case of bitmaps, alpha values may be used in order to combine at least two distinct bitmaps in order to create a blended composite image. Therefore, in addition to the RGB components that represent an object's hue (its color), an additional A, or alpha, component is used to represent the bitmap's opacity (its capacity to obstruct the transmission of light). The technique of using an A component in conjunction with RGB is often referred to ARGB. When A equals 1, the object obstructs all light from shining through it; when A equals 0.25, that is an opacity of 25 percent, then 75 percent of light striking the object passes through it. Therefore, when A equals 0, total transparency is achieved.

Blending in ARGB mode allows source and destination pixel values to be combined in various ways. The blend of the source and destination pixels is a linear combination of their ARGB components. That is, source blending the factors ($\beta_A$, $\beta_R$,$\beta_G$,$\beta_B$) and destination blending factors ($\gamma_A$,$\gamma_R$,$\gamma_G$,$\gamma_B$) are defined as multipliers of the source and destination colors ($A_S$, $R_S$, $G_S$, $B_S$) and ($A_D$, $R_D$, $G_D$, $B_D$), and these weighted colors are added to get the blended ARGB value.

Therefore, when blending two separate bitmaps to create one composite bitmap for display in a GUI, first the foreground bitmap is rendered and stored in memory, and then the background bitmap is rendered and stored in memory. These two bitmaps are then blended together, pixel by pixel, to create a composite image that is displayed on the GUI.

Unfortunately, it is difficult to render TrueType fonts on ARGB bitmaps. In particular, when ARGB bitmaps include a combination of a translucent or semi-translucent foreground with a background having a given color, where it is desirable to use the TrueType font on the foreground. The computation required to display a TrueType font on a foreground necessitates taking into consideration the color of the background. This is because rendering TrueType fonts, without significant color fringing, requires certain information about the properties of the background the fonts are rendered on. However, until a foreground ARGB is combined with a background ARGB, the actual background is simply unknown. And even if the background were known, then the computation required to render the TrueType font would require a potentially large amount of computational time. It would be better if this computational burden could be used by an operating system, implementing a GUI, for other purposes.

SUMMARY OF THE INVENTION

The exemplary embodiments of the present invention substantially eliminate the requirement of taking into consideration a background ARGB when a foreground ARGB is combined with the background ARGB to create a composite image that may be displayed on a display device. This is very useful when the foreground ARGB includes TrueType fonts that have been visually improved using Microsoft's ClearType® technology, or any other font improving technology that takes into consideration a background color when visual improvement is processed. In particular, the exemplary embodiments of the present invention are useful in reducing color fringing, even if the background ARGB is not taken into consideration before a foreground ARGB including TrueType fonts is combined therewith to create a composite image for display on a display device.

According to one exemplary embodiment of the present invention, a method includes determining a color of text; rendering the text on a background that contrasts with the text; and determining an alpha value based on a pixel scan of the background having the text rendered thereon, wherein the determined alpha value is usable with substantially all text rendered on background graphics for display on a display device.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE EXEMPLARY EMBODIMENTS

The description of the exemplary embodiments of the present invention discloses apparatus and methods for displaying graphic information using a graphical user interface (GUI) implemented with a computer type system. In the following description, numerous specific details are set forth in order to provide a thorough understanding of the exemplary embodiments of the present invention. However, it will be apparent to those of ordinary skill in the art that the present invention may be practiced without the disclosed specific details. In other instances, well known circuits and instructions are not described in detail in order not to obscure the present invention unnecessarily.

Figure 1:
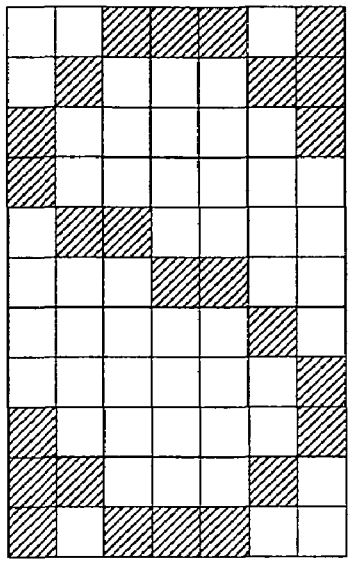
FIG. 1 shows a 12-point regular (non-italics, non-bold) "S" rendered using a full-pixel rendering technique.
Figure 2:
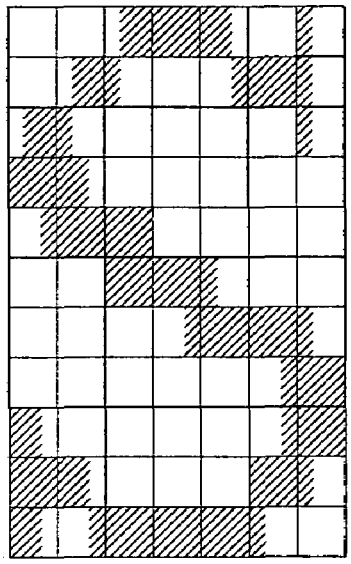
FIG. 2 illustrates what the capital "S" looks like at the sub-pixel level when the pixels shown in FIG. 1 are shifted one-third of a pixel to the right.
Figure 3:
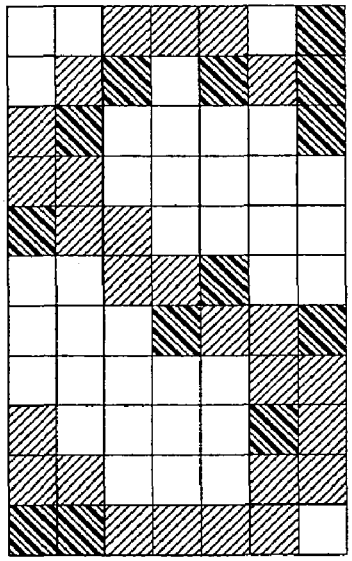
FIG. 3 illustrates the capital "S" of FIG. 2, where partially filled pixels are each rendered with a prescribed gray level.
Figure 4:
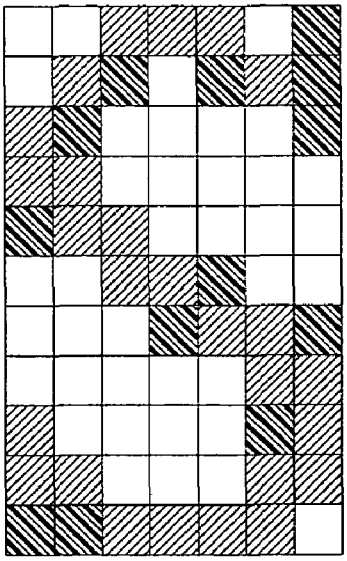
FIG. 4 illustrates the anti-aliased letter rendered for a color matrix display, with the red-green-blue sequenced sub-pixels elements.
Figure 5:
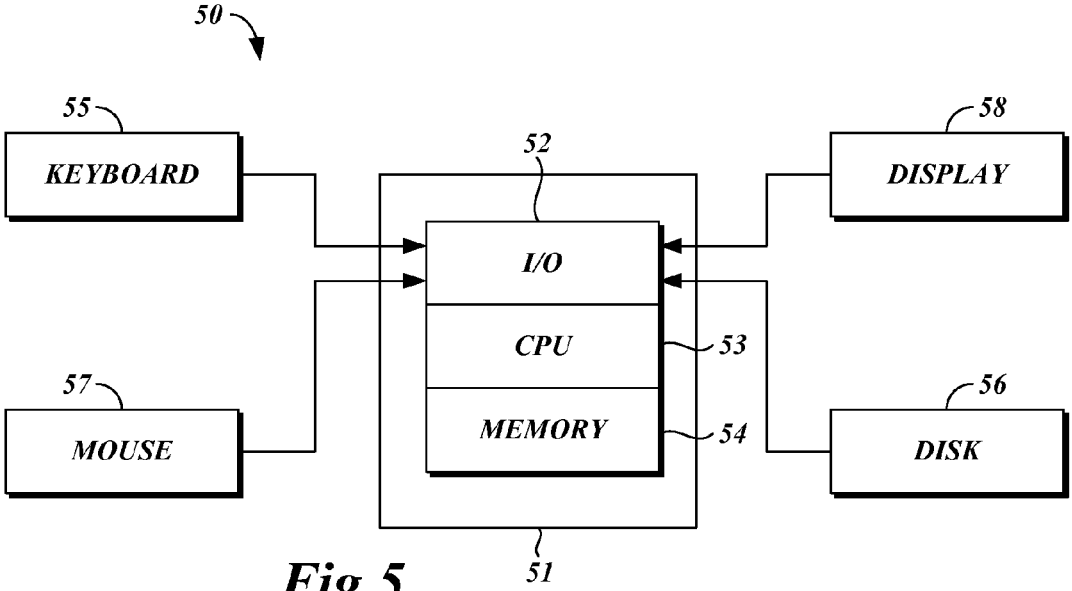
FIG. 5 illustrates a system for generating a GUI that may be used to implement the exemplary embodiments of the present invention.

FIG. 5 illustrates a system for generating a GUI that may be used to implement the exemplary embodiments of the present invention. Illustrated is a computer 50 that includes at least three major components. The first component is an input/output (I/O) circuit 52 that is housed within an enclosure 51. The I/O circuit 52 is used to communicate information in appropriately structured form to and from other portions of the computer 50. In addition, the computer 50 includes a central processing unit (CPU) 53 coupled to the I/O circuit 52, and a memory 54. The elements discussed in relation to the enclosure 51 are those typically found in most general purpose computers, and in fact, the computer 50 is intended to be representative of a broad category of data processing devices.

Also illustrated in FIG. 5 is a keyboard 55 that may be used to input data and commands into the computer 50. A magnetic disk 56 is shown coupled to the I/O circuit 52 to provide additional storage capacity for the computer 50. It will be appreciated that additional devices may be coupled to the computer 50 for storing data, such as magnetic tape drives, bubble memory devices, as well as networks which are in turn coupled to other data processing systems. Moreover, as is well known, the disk 56 may store other computer programs, characters, routines, etc., which may be accessed and executed by the CPU 53.

A display 58 is shown coupled to the 110 circuit 52 and is used to display images generated by the CPU 53 in accordance with the exemplary embodiments of the present invention. Any known variety of displays may be used in conjunction with the computer 50; however, it may be desirable to use an LCD with the exemplary embodiments of the present invention. A cursor-control device, or mouse 57, is also shown coupled to the computer 50 through the I/O circuit 52 contained within the enclosure 51. The mouse 57 permits a user to select various command modes, modify graphic data, and input other user data utilizing switches and/or buttons commonly implemented with mouse-type input devices.

Figure 6:
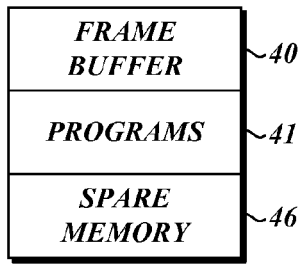
FIG. 6 illustrates one arrangement of several major elements contained within a memory illustrated in FIG. 5.

FIG. 6 illustrates one arrangement of several major elements contained within the memory 54 illustrated in FIG. 5. In particular, the memory 54 includes a frame buffer 40, which includes at least one bitmap of the display 58. The frame buffer 40 represents the video memory for the display 58, wherein each storage location including a plurality of bits in the frame buffer 40 corresponds to a pixel or a plurality of sub-pixels on the display 58. Therefore, the frame buffer 40 includes a two-dimensional array of points having known coordinates corresponding to the pixels of the display 58. In the simplest form, the frame buffer 40 includes a contiguous block of memory which is allocated such that each memory location is mapped onto a corresponding pixel of the display 58. The memory 54 also includes a variety of other programs 41 for execution by the CPU 53. For example, a variety of control, display, and calculating programs implementing the operations and routines of the computer 50 may be stored in the memory 54. Moreover, the memory 54 also includes spare memory 46 for use by other programs that may be used by the computer 50 for completing and processing a variety of other functions and operations.

Figure 7:
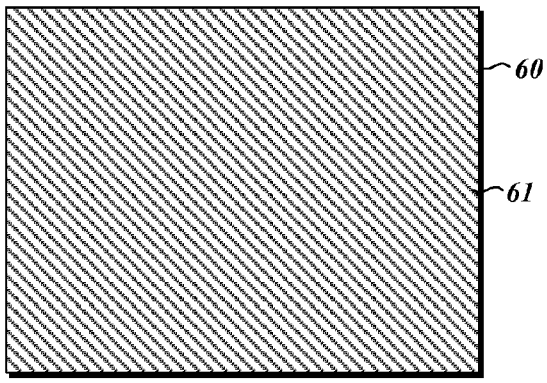
FIG. 7 illustrates a background graphic stored in a frame buffer of the system illustrated in FIG. 5.

FIG. 7 illustrates a background graphic stored in the frame buffer 40. As is illustrated in the figure, the background graphic 60 has a particular color 61. The exact color of the background graphic 60 may be one of many known different colors. The background graphic 60 can be of the RGB type, or the ARGB type, and furthermore, may be displayed on the display 58 in the illustrated form.

Figure 8:
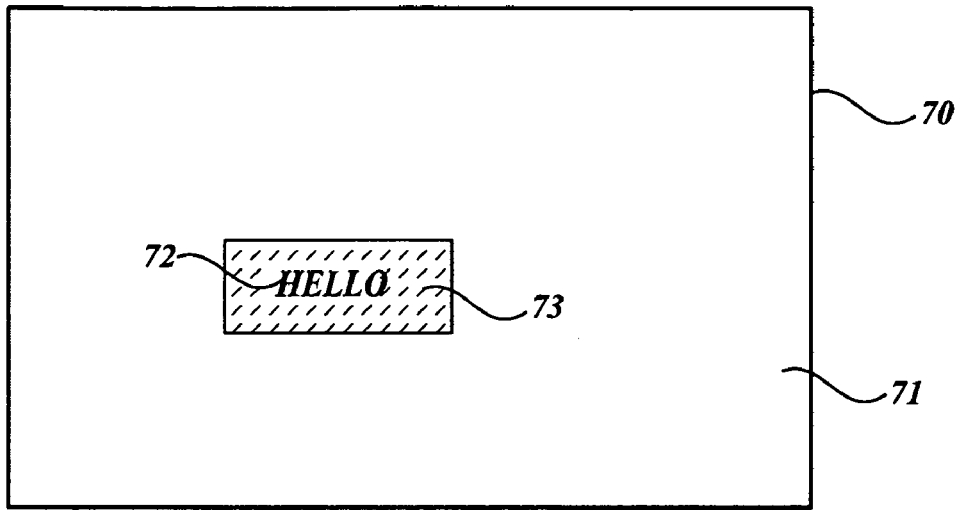
FIG. 8 illustrates a foreground graphic that is stored in the frame buffer of the system illustrated in FIG. 5.

FIG. 8 illustrates another graphic, in this case a foreground graphic 70, stored in the same buffer 40. The foreground graphic 70 includes a substantially clear portion 71. Therefore, the A components of the ARGB components associated with the substantially clear portion 71 would be zero, or a value that is very close to zero. The foreground graphic 70 also includes text 72 superimposed over a partially transparent portion 73. Therefore, the A components of the ARGB components of the partially transparent portion 73 would be a value less than 1, but greater than 0. Although the foreground graphic 70 may be displayed alone on the display 58, the foreground graphic 70 is meant to be blended with the background graphic 60.

Figure 9:
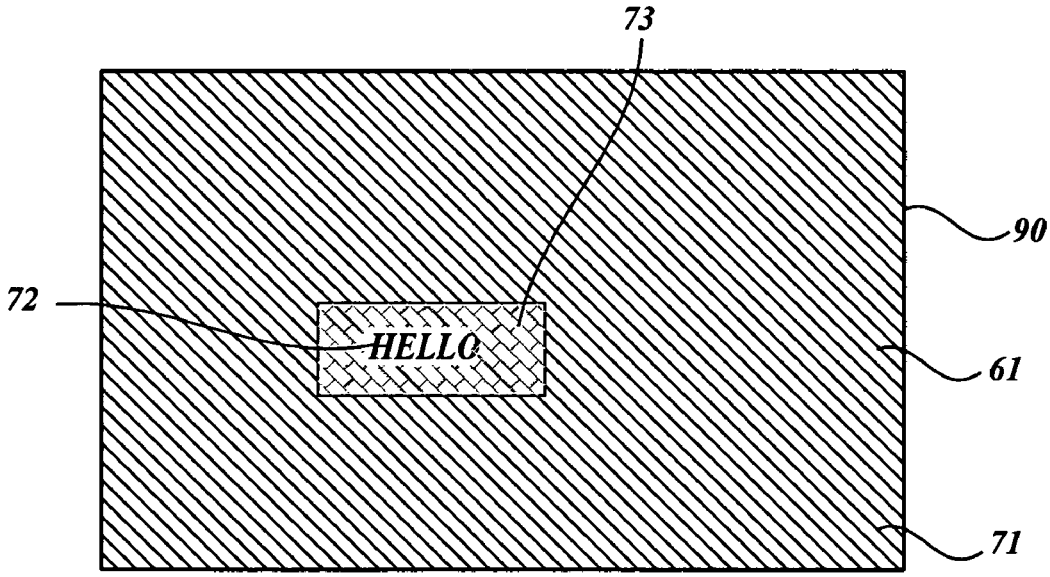
FIG. 9 illustrates a composite graphic after a background graphic and a foreground graphic have been blended together to create a composite graphic.

FIG. 9 illustrates a composite graphic 90 after the background graphic 60 and the foreground graphic 70 have been blended together to create a composite of the two graphics 60 and 70. As is illustrated in the figure, the composite graphic 90 includes the color 61 of the background graphic 60, along with the clear portion 71, the partially transparent portion 73, and the text 72.

Using conventional techniques, if the text 72 is TrueType text, or another text other than a plain bitmap, then color fringing around the outline of the text 72 would occur because the color 61 was unknown before the two graphics 60 and 70 were blended together to create the composite graphic 90. As an alternative, to avoid unwanted color fringing, then the text 72 would need to be rerendered by taking into consideration the color 61 of the background graphic 60. In other words, the text 72 would be rendered first on the foreground graphic 70 and rendered again when the foreground graphic 70 is blended with the background graphic 60. This technique is not generally supported by conventional display rendering hardware and software. Moreover, the necessity of re-rendering text based on a background graphic would require a potentially large processing burden on the system.

In accordance with the exemplary embodiments of the present invention, a color of a background graphic must not be known when a foreground graphic is blended with a background graphic to create a composite image. Therefore, potentially unnecessary processing requirements on a computer system when rendering a graphic on a display are substantially eliminated.

Figure 10:
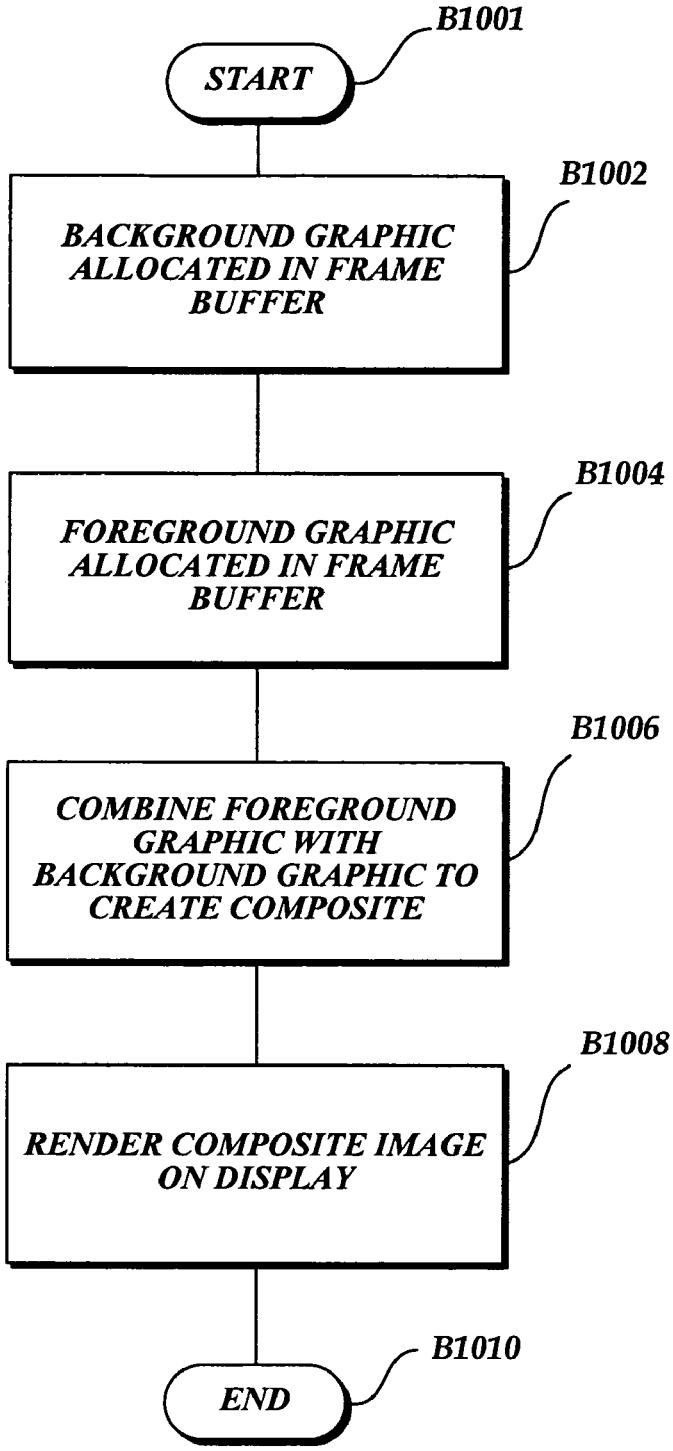
FIG. 10 is a flowchart illustrating a method of rendering an image on a display in accordance with an exemplary embodiment of the present invention.

FIG. 10 is a flowchart illustrating a method of rendering an image on the display 58 in accordance with an exemplary embodiment of the present invention. The method illustrated in conjunction with the flowchart is processed using the computer 50. However, as is clearly understood by those of skill in the art, other processing devices may also be used to perform the method in accordance with the exemplary embodiments of the present invention.

Referring to FIG. 10, block B1001 represents the beginning of the process of rendering a graphic on the display 58. In block 1002, a bitmap, or background graphic, such as the background graphic 60, is allocated in the frame buffer 40. Next, an additional graphic, such as the foreground graphic 70, is allocated in the frame buffer 40 (B1004). The foreground graphic includes the text 72, such as TrueType text rendered using the ClearType® technology, along with a partially transparent portion 73 and the substantially transparent portion 71. Both the background graphic 60 and the foreground graphic 70 are ARGB bitmaps.

Unlike the conventional methods for rendering composite ARGB bitmaps, an exemplary embodiment to the present invention does not require information pertaining to the background graphic 60 in order to lessen color fringing that may occur when the background graphic 60 and the foreground graphic 70 are blended together to create the composite graphic 90. In particular, in block B1004, the foreground graphic 70, stored in the frame buffer 40, includes TrueType text 72 that is allocated using a predetermined alpha value (A value), empirically found to minimize color fringing when the foreground graphic 70 is combined with the background graphic 60 to create the composite graphic 90. Once both the foreground graphic 70 and the background graphic 60 are allocated in the frame buffer 40, then these graphics 60 and 70 are combined to create the composite graphic 90 (B1006).

In the case of the exemplary embodiments of the present invention, the combining block B1006 does not require considering the actual color of the background graphic 70 in order to substantially eliminate any color fringing that may occur because TrueType text is used in conjunction with the foreground graphic 70. Finally, the composite graphic 90 is rendered on the display 58 (B1008). Block B1010 represents determination of a process for rendering a graphic on the display 58 in accordance with an exemplary embodiment of the present invention.

In the following description general concepts and formulas are provided. These general concepts and principles may be used to determine A values for TrueType text allocated to foreground graphics that may be used in conjunction with background to create composite graphics for display on display devices.

Figure 11:
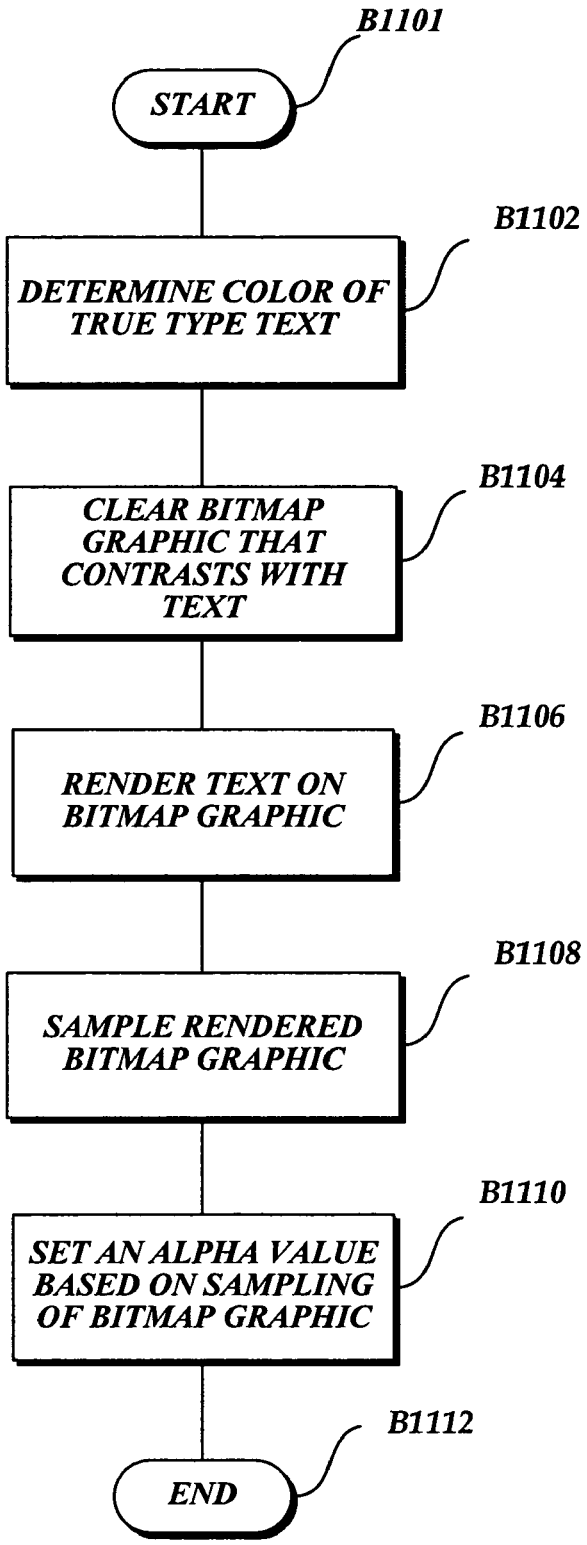
FIG. 11 is a flowchart illustrating an exemplary embodiment related to a method for estimating an alpha value that may be used in conjunction with TrueType text rendered on a graphic.

FIG. 11 is a flow chart illustrating an exemplary embodiment related to a method for estimating an alpha value that may be used in conjunction with TrueType text rendered on foreground graphics. Block B1101 represents a starting point for the method in accordance with an exemplary embodiment to the present invention. First, the color of a TrueType text is determined (B1102). Next, a bitmap graphic that contrasts with the color of the True Type text is cleared (B1104). For example, in the case where the TrueType text of block B1102 is black, the bitmap graphic cleared in block B1104 might be white, or a color very close to white. Next, the text is rendered on the cleared bitmap graphic (B1106). Then, the bitmap graphic rendered with the text is sampled pixel by pixel (B1108). Any of the text pixels that are sampled that have the same color as the cleared bitmap graphic are assigned an alpha value of 0, and any of the text pixels that are sampled that have the same color as the color of the text are assigned an alpha value of 1. The remaining sampled pixels are assigned an alpha value between 0 and 1, depending on an amount of color in the cleared bitmap graphic that was perturbed. In particular, the remaining sampled pixels that are assigned an alpha value between 0 and 1 are those pixels that are not the same color of either the cleared bitmap graphic color or the text color. The determined alpha value is based on the sampling of the bitmap graphic (B1110). Block B1112 represents the end of the flowchart illustrated in FIG. 11.

Based on empirical experimentation, the following formula may be used for determining an alpha value that may be used with any background color and any text color. The formula is as follows:

$$Alpha=0.299*red+0.57*green+0.114*blue$$

where

BackgroundColor=(RedBackground, BlueBackground, GreenBackground);

TextColor=(RedText, BlueText, GreenText);

PixelColor=(RedPixel, BluePixel, GreenPixel, Alpha); and red=(RedPixel−RedBackground)/(RedText−RedBackground)

blue=(BluePixel−BlueBackground)/(BlueText−BlueBackground)

green=(GreenPixel−GreenBackground)/GreenText−GreenBackground)

The BackgroundColor variable corresponds to the color of the bitmap graphic cleared in block B1105. The TextColor variable corresponds to the desired color of a text being rendered on the cleared background graphic, before it undergoes processing using the ClearType® technology, or anti-aliasing. Finally, the PixelColor variable corresponds to the text after it is rendered on the cleared background graphic, see block B1106 of FIG. 11.

NOTE: if the RedText equals RedBackground then the red color will not be adjusted (to avoid divide by zero errors). This is true for the blue and green components, also.

It may also be necessary to determine a color to combine with the Alpha. It is possible to use the color calculated by the ClearType® algorithm, but this may not produce a satisfactory result, because the Alpha value tends to mute the color, resulting in etched-looking text. Therefore, blending the PixelColor and TrueType color, after the ClearType® has been applied, may produce more readable text. Those of ordinary skill in the art recognize various blending techniques may be used when blending the text color with the TrueType color.

The formula provided is just one example of an equation that may be used to determine an alpha value. The provided equation is a simple linear approximation of the amount that the background color was adjusted towards the text color. There are many such linear and non-linear equations that could be used. For example, the provided formula compensates for the sensitivity of the eye to certain colors, but one could also use a simple average of the red, green and blue colors. The eye also has different sensitivities to different color intensities, so a formula could be used that takes into account different ratios for different magnitudes of the red, green, and blue components of a pixel.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of displaying text, the method comprising:

determining a color of text;

rendering the text on a high-contrast background having a color, the color of the high-contrast background contrasting with the color of the text;

calculating an alpha value between 0 and 1 based on a pixel scan of the high-contrast background having the text rendered thereon, the alpha value being calculated based on a linear combination of RGB colors of a combination of the colors of the high-contrast background, the text, and the text rendered on the high-contrast background;

applying the calculated alpha value to the text when the text is rendered on a display background that is different from the high-contrast background for display on a display device; and presenting the text rendered on a display background that is different from the high-contrast background.

2. The method according to claim 1, further comprising using the calculated alpha value only with sampled pixels that are not either the same color as the display background or the text.

3. The method according to claim 2, further comprising using an alpha value of 0 or 1 with sampled pixels that are either the same color as the display background or the text.

4. The method according to claim 3, wherein an alpha value of 0 is used with sampled pixels that are the same color as the display background.

5. The method according to claim 3, wherein an alpha value of 1 is used with sampled pixels that are the same color as the text color.

6. The method according to claim 5, wherein the foreground graphic and the background graphic are ARGB graphics.

7. The method according to claim 1, further comprising alpha blending a foreground graphic with a background graphic, the foreground graphic including text, wherein a color of the text on the foreground graphic is not taken into consideration when the foreground graphic and the background graphic are blended.

8. The method according to claim 7, wherein the alpha value is used during the blending of the foreground graphic with the background graphic.

9. The method according to claim 8, wherein the text is a mathematically specified text rendered using a three-tap finite impulse response filter to sample each of the RGB colors of the text alternately.

10. The method according to claim 1, wherein the text is a mathematically specified text rendered using a three-tap finite impulse response filter to sample each of the RGB colors of the text alternately.

11. A method of displaying text, the method comprising:

(a) determining a color of a mathematically specified text;

(b) determining a color of an ARGB bitmapped background graphic that has a high contrast with the color of the mathematically specified text;

(c) rendering the mathematically specified text on the background graphic using a three-tap finite impulse response filter to sample each of the RGB colors of the text alternately;

(d) scanning each pixel of the background graphic with the mathematically specified text rendered thereon;

(e) calculating an alpha value for each pixel of the background graphic with the mathematically specified text rendered thereon, the calculation including:

(i) assigning an alpha value of 0 (zero) for each pixel having the same color as the background graphic color;

(ii) assigning an alpha value of 1 (one) for each pixel having the same color as the mathematically specified text color; and (iii) assigning an alpha value between 0 and 1, based on a predetermined formula, for each pixel not having the same color as either the background graphic color or the mathematically specified text color, the predetermined formula being based on a linear combination of RGB colors of a combination of the colors of the high-contrast background, the text, and the text rendered on the high-contrast background;

(f) applying the calculated alpha values corresponding to each pixel to the mathematically specified text when the mathematically specified text is rendered on a display background that is different from the background graphic for display on a display device; and (g) presenting the text rendered on a display background that is different from the high-contrast background.

12. A method of displaying text, the method comprising:

determining a color of text;

rendering the text on a high-contrast background having a color, the color of the high-contrast background contrasting with the color of the text;

calculating an alpha value from 0 to 1 based on a pixel scan of the high-contrast background having the text rendered thereon, the alpha value being calculated based on a linear combination of RGB colors of a combination of the colors of the high-contrast background, wherein the linear combination of RGB colors of a combination of the colors of the high-contrast background is based on: (i) the color of the high-contrast background, (ii) the color of the text being rendered on the high-contrast background and (iii) the text rendered on the high-contrast background;

using the calculated alpha value only with sampled pixels that are not either a same color as a display background or the text, wherein an alpha value of 0 is used with sampled pixels that are the same color as the display background and an alpha value of 1 is used with sampled pixels that are the same color as the text color;

applying the calculated alpha value to the text when the text is rendered on a display background that is different from the high-contrast background for display on a display device; and presenting the text rendered on a display background that is different from the high-contrast background.

* * * * *